US005551891A

United States Patent [19]

Huss, Jr.

[11] Patent Number: 5,551,891

[45] Date of Patent: Sep. 3, 1996

[54] ELECTRICAL CONNECTOR WITH BOARDLOCK RETENTION FEATURE

[75] Inventor: John P. Huss, Jr., Harrisburg, Pa.

[73] Assignee: The Whitaker Corporation, Wilmington, Del.

[21] Appl. No.: 414,688

[22] Filed: Mar. 31, 1995

[51] Int. Cl.[6] ..... H01R 13/73

[52] U.S. Cl. ..... 439/567

[58] Field of Search ..... 439/567, 571, 439/572

[56] References Cited

U.S. PATENT DOCUMENTS

| | | | |
|---|---|---|---|
| 4,907,987 | 3/1990 | Douty et al. | 439/571 |
| 5,074,807 | 12/1991 | Parmer | 439/553 |
| 5,145,407 | 9/1992 | Obata et al. | 439/567 |
| 5,171,165 | 12/1992 | Hwang | 439/567 |
| 5,336,111 | 8/1994 | Thrush et al. | 439/567 |
| 5,422,789 | 6/1995 | Fisher et al. | 439/567 |

*Primary Examiner*—Gary F. Paumen
*Attorney, Agent, or Firm*—Anton P. Ness

[57] ABSTRACT

An electrical connector comprises, conductive electrical contacts (3) in an insulating housing (2), at least one conducting boardlock (4) is received in a corresponding cavity (21) in the housing (2), an opening (24) provides first and second locking shoulders (25, 26) adjacent to the cavity (21), and the boardlock (4) is capable of facing in either of two directions within the cavity (21) to lockingly engage one or the other of the locking shoulders (25 or 26), and the boardlock (4) can be unlocked from the shoulders (25 or 26) by a slender tool that is inserted along the opening (24) to deflect the boardlock (4) away from the latching shoulders (25 or 26).

4 Claims, 3 Drawing Sheets

ELECTRICAL CONNECTOR WITH BOARDLOCK RETENTION FEATURE

FIELD OF THE INVENTION

The invention relates to an electrical connector with a boardlock for connection in an aperture of a circuit board, and more particularly, to a structural feature on a boardlock and a portion of an electrical connector that provides ease of assembly of a boardlock with an electrical connector.

BACKGROUND OF THE INVENTION

According to U.S. Pat. Nos. 4,907,987, and 5,074,807, an electrical connector comprises, an insulating housing containing electrical contacts, and conductive boardlocks for connection in-respective apertures in a circuit board on which the housing is mounted. A mounting post on each of the boardlocks is constructed for receipt in an aperture that extends through a circuit board. Another portion on the boardlock extends upwardly for frictional engagement in a portion of the insulating housing to assemble the boardlock with the housing. Radially projecting barbs on the boardlock are intended to grip an interior of a cavity in the housing to retain the boardlock with the housing. A difficulty can occur during assembly of the boardlock with the housing. The barbs are intended to bite into the housing as the boardlock is assembled along the cavity in the housing. The barbs are the sole feature for locking the boardlock with the housing. A high level of frictional locking is required of the boardlocks. Sometimes the boardlock is aligned crooked, and must be removed from the housing and replaced. Since the barbs resist removal, replacement of the boardlock is accomplished with difficulty.

According to U.S. Pat. No. 5,074,807, removal of the boardlocks is desired, for example, to replace a damaged boardlock, or to replace a boardlock that is misaligned by being crooked when assembled to the housing. According to the patent, each of the boardlocks has a central cavity that allows the boardlock to radially collapse. Collapse of the boardlock will disengage the boardlock from frictional engagement with the housing. The collapsed boardlock is easily removed from the housing. However, radial collapse is a disadvantage that could occur at unwanted times, for example, when the boardlock is thrust into an aperture in a circuit board. Further, a collapsed boardlock is damaged and is not reusable.

SUMMARY OF THE INVENTION

According to the invention, an electrical connector and a boardlock are constructed with a locking feature that is easily disengaged to permit removal and replacement of the boardlock.

A feature of the invention further permits locking engagement of a boardlock within a cavity in a housing, with the boardlock facing in different directions. The boardlock is capable of facing in either of two directions within the corresponding cavity to avoid incorrect assembly of the boardlock.

According to the invention, a boardlock is mounted in each corresponding cavity in the housing. Each cavity is intersected by a corresponding opening in the housing, internal walls on each opening provide first and second locking shoulders adjacent to opposite sides of the corresponding cavity, and each boardlock is capable of facing in either of two directions within the corresponding cavity to avoid incorrect assembly of the boardlock, with the first locking lance being lockingly engaged on the first shoulder when the boardlock faces a first of said two directions, and with the second locking lance being lockingly engaged on the second shoulder when the boardlock faces a second of said two directions, whereby incorrect assembly of the boardlock is avoided. Removal of the boardlock is facilitated by, first, inserting a rod like tool along the opening to resiliently deflect the corresponding locking lance into the thickness plane of the boardlock, thus unlocking the boardlock from the locking shoulder. Then the boardlock is removed while the locking lance is unlocked.

DETAILED DESCRIPTION

Figure 1:
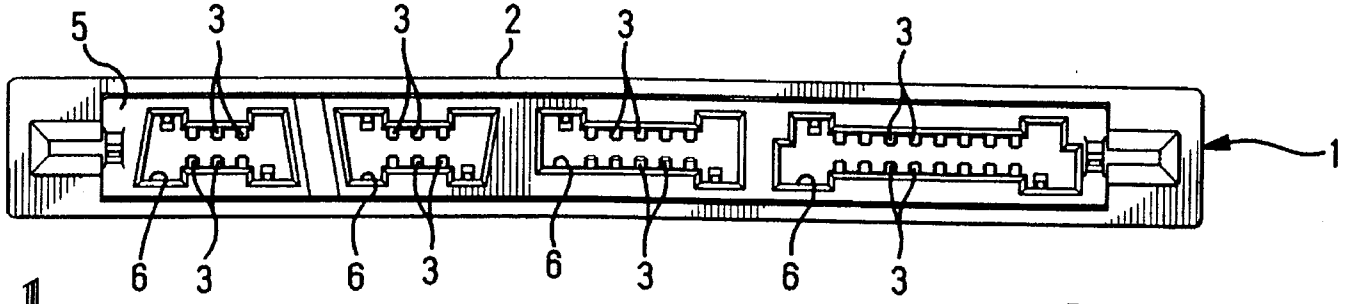
FIG. 1 is a top view of an electrical connector comprising, an insulating housing, electrical contacts in the housing, and conductive boardlocks.
Figure 2:
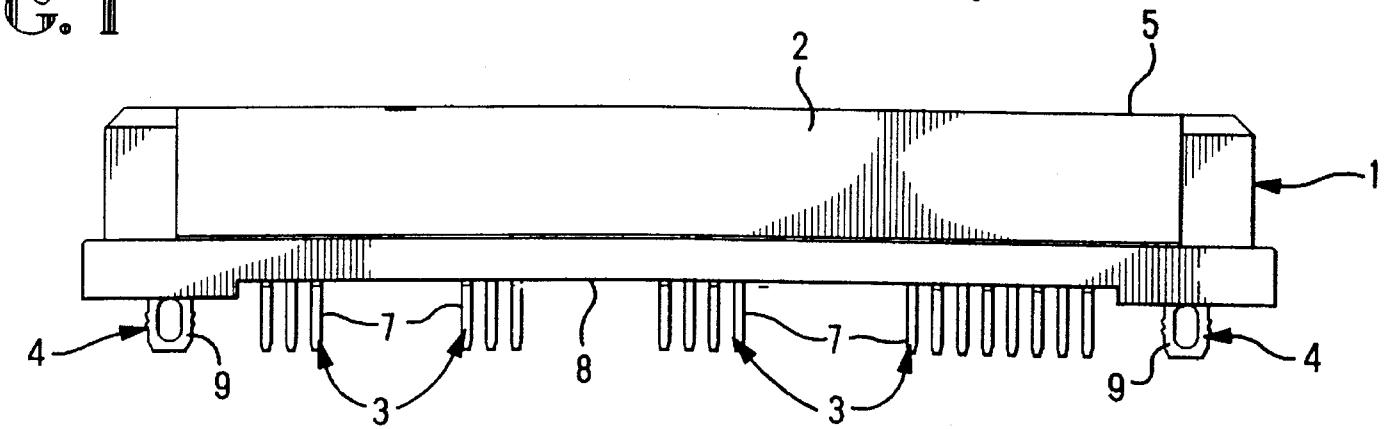
FIG. 2 is a side view of the connector shown in FIG. 1.
Figure 3:
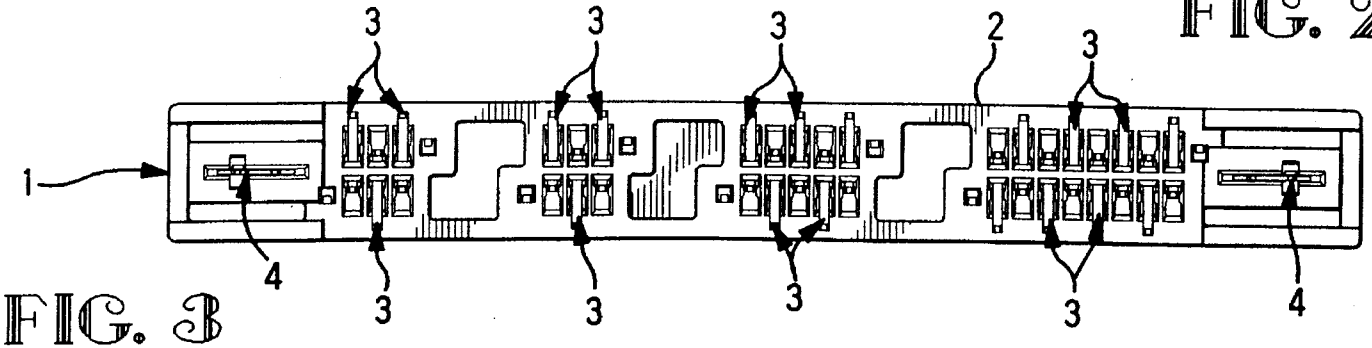
FIG. 3 is a bottom view of the connector shown in FIG. 2.
Figure 4:
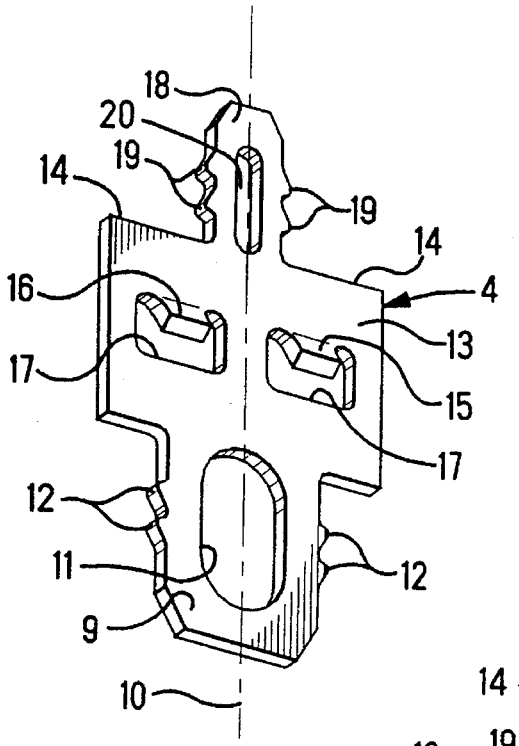
FIG. 4 is an enlarged isometric view of a boardlock prior to mounting in the connector as shown in FIG. 2.
Figure 5:
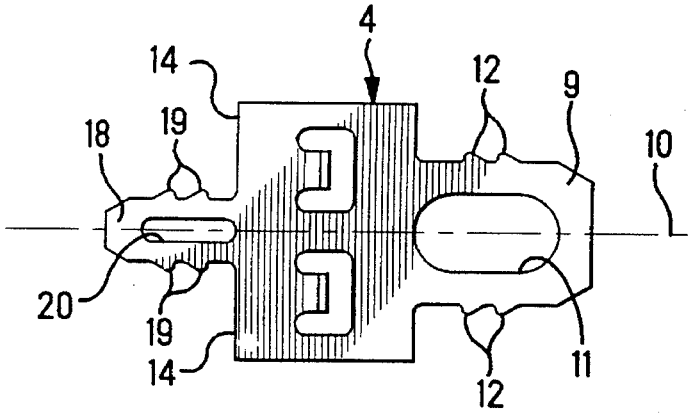
FIG. 5 is a view of one side of the boardlock as shown in FIG. 4.

With reference to FIGS. 1, 2 and 3, an electrical connector 1 comprises an insulating housing 2, conductive electrical contacts 3 in the housing 2 and conducting boardlocks 4 projecting from the housing 2. The insulating housing 2 is of unitary molded plastics construction. A top surface 5 on a top of the housing 2 has at least one mating plug receiving opening 6 that has a profile shape that conforms to a complementary shape on the outer periphery of a mating plug type connector, not shown. As shown in FIG. 1, each plug receiving opening 6 is of a different profile shape to mate with respective plugs of different, complementary shapes.

The contacts 3 are stamped and formed from a metal blank, and are then plated in a known manner to resist formation of oxides that would interfere with electrical conductivity of the contacts 3. The contacts 3 are located in the housing to communicate with respective plug receiving openings 6. The contacts 3 in each opening 6 are constructed to mate with a corresponding plug, not shown, that is received in the corresponding opening 6. Post portions 7, FIG. 2, on the contacts 3 project outwardly from a bottom surface 8 on the housing 2 for plugging into respective mounting apertures in a circuit board, not shown. Further details of the connector 2 are specified in an industry standard, IEEEP-1394.

Each of the conducting boardlocks 4 projects from the bottom surface 8, the surface 8 having a stepped construction that would raise the surface 8 where the contacts 3 project therethrough. Each of the boardlocks 4 has a construction that will now be described with reference to FIGS.

4 and 5. Each boardlock 4 is of unitary construction, stamped and formed from a unitary metal plate having a plane of thickness that forms a plane of thickness of the boardlock 4. A first portion comprising an elongated post 9 on the boardlock 4 projects along an imaginary, central axis of rotation 10 of the boardlock 4. An opening 11 through the post 9 provides narrow and resiliently deflectable sides of the post 9 for resilient frictional engagement with an interior of a mounting aperture, not shown, in a circuit board, not shown. Radially projecting barbs 12 in the thickness plane project from opposite sides of the post 9 to engage the interior of the mounting aperture to resist accidental removal of the post 9 from the aperture.

The post 9 projects downward from a central flange 13 in the thickness plane of the boardlock 4. The flange 13 projects radially in two directions from the axis 10, and provides a pair of radially aligned, horizontal shoulders 14 that are symmetrically located about the axis 10. A first locking lance 15 and a second locking lance 16 are formed by respective slits 17 through the thickness of the flange 13, each slit 17 having three sides. The locking lances 15, 16 are struck out of the thickness plane of the boardlock 4 to project diagonally outward of the thickness plane. The locking lances 15, 16 are resiliently deflectable toward and away from the thickness plane. Further, the locking lances 15, 16 are radially symmetrically spaced from the axis 10.

A second portion comprising an elongated post 18 projects in an upward direction from the flange 13. The second post 18 projects centrally along the axis 10. Radially projecting barbs 19 in the thickness plane of the boardlock 4 project from opposite sides of the post 18. A central opening 20 through the post 18 provides narrow and resiliently deflectable sides of the post 18 to engage the housing 2 in a manner to be described.

Figure 6:
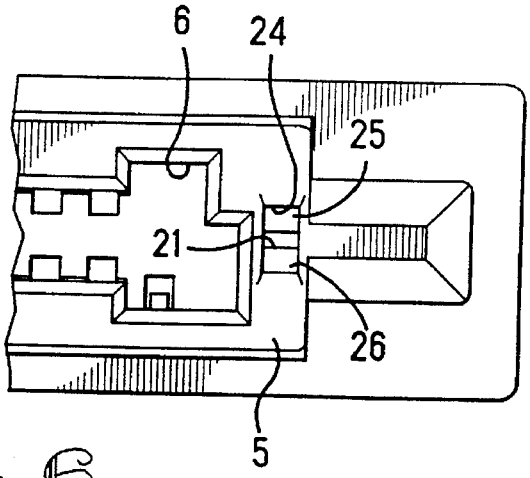
FIG. 6 is an enlarged top view of a portion of a housing of the connector as shown in FIG. 1.
Figure 7:
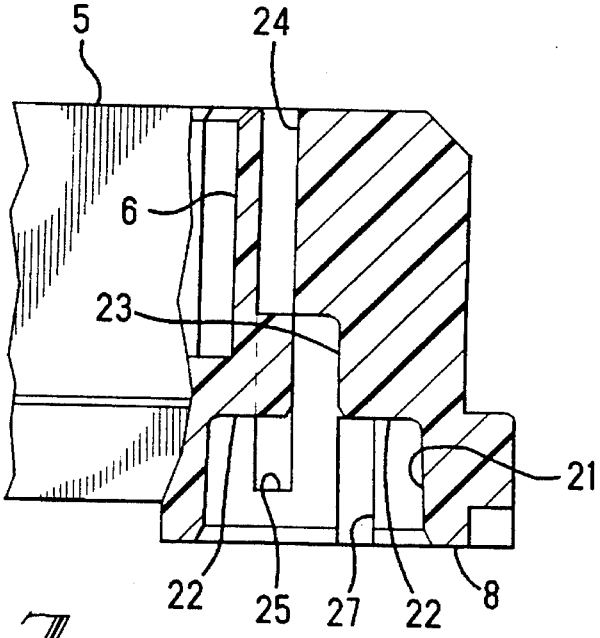
FIG. 7 is an enlarged side view of a portion of a housing of the connector as Shown in FIG. 2, with parts cut away.
Figure 8:
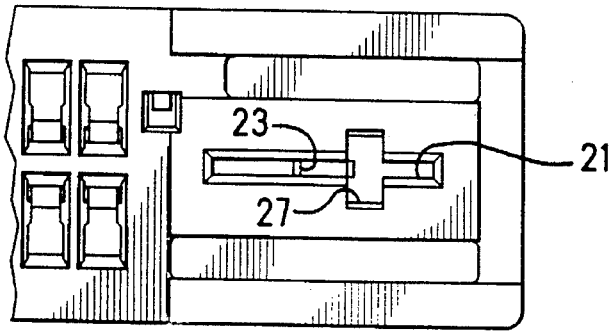
FIG. 8 is an enlarged bottom view of a portion of a housing of the connector as shown in FIG. 3.

With reference to FIGS. 6, 7 and 8, a boardlock receiving cavity 21 communicates with the bottom surface 8 (the insertion face in the embodiment disclosed herein), and extends upward from the bottom surface 8. The cavity 21 has a narrow, slit width FIG. 8 to receive the width of the flange 13 therein. An inverted bottom 22 of the cavity 21 is in the interior of the housing 2, and provides a stop against which the shoulders 14 register to limit insertion 0f the flange 13 along the cavity 21. A narrow portion! 23 of the cavity 21 extends upward from the inverted bottom 22. The narrow portion 23 of the cavity 21 receives a corresponding second post 18 on a corresponding boardlock 4.

With reference to FIGS. 6 and 7, each corresponding cavity 21 is intersected by a corresponding first opening 24 in the housing 2. The corresponding opening 24 extends from the top surface 5 on the housing 2 toward the cavity 21. The opening 24 is recessed in and along both opposite sides of the cavity 21. The opening 24 extends for a depth that intersects the bottom 22 of the cavity 21. The opening 24 extends below the bottom 22 of the cavity 21. An internal bottom of the opening 24 is spaced below the bottom 22, and define first and second locking shoulders 25, 26, respectively, facing away from the insertion face, bottom surface 8. The locking shoulders 25, 26 are adjacent to opposite sides of the corresponding cavity 21, and are formed by the single opening 24.

Figure 9:
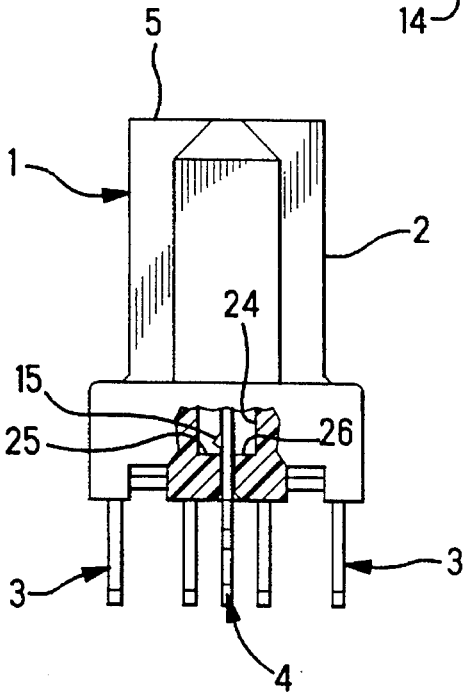
FIG. 9 is an end view of the housing of the connector as shown in FIG. 2 with parts cut away.

Each boardlock 4 is capable of assembly with a corresponding cavity 21. The boardlock 4 is inserted in a corresponding cavity 21 with the second post 18 facing toward the cavity 21. The post 18 is inserted into and registers within the narrow portion 23 of the cavity 21 with an interference fit of the barbs 19 radially against opposite sides of the narrow portion 23 of the cavity 21. The flange 13 registers within the cavity 21. During assembly of the flange 13 along the narrow cavity 21, opposite sides of the cavity 21 will bias the lances 15, 16 resiliently toward and into the thickness plane of the boardlock 4, allowing passage of the boardlock 4 along the narrow cavity 21. When the boardlock approaches complete insertion along the cavity 21, for example, as shown in FIG. 9, a corresponding one of the locking lances 15, 16 will be opposite the corresponding opening 24. The corresponding one of the lances 15, 16 will deflect by resilient spring action, outwardly of the thickness plane of the boardlock 4 and into the opening 24 to lockingly engage a corresponding shoulder 25, 26, and resist withdrawal of the boardlock 4 from the housing 2.

To avoid incorrect assembly of the boardlock 4 in a corresponding cavity 21, each boardlock 4 is capable of facing in either of two directions during insertion within the corresponding cavity 21. This is accomplished with the first locking lance 15 being lockingly engaged on the first shoulder 25 when the boardlock 4 faces a first of said two directions, and with the second locking lance 16 being lockingly engaged on the second shoulder 26 when the boardlock 4 faces a second of said two directions, whereby incorrect assembly of the boardlock 4 is avoided.

The boardlock 4 is locked with the housing 2 by the corresponding one of the locking lances 15, 16. This allows for easy release and withdrawal of the boardlock 4 for repair and replacement purposes. A tool in the form of a slender rod is inserted from the top surface 5 of the housing 2 along the opening 24 to deflect the corresponding one of the locking lances 15, 16 toward and into the thickness plane of the boardlock 4 to unlock the boardlock 4 from the housing 2, and allow passage of the unlocked boardlock 4 outwardly of the cavity 21.

With reference to FIGS. 7 and 8, each corresponding cavity 21 extends along a corresponding second opening 27 in the mounting surface 8. The corresponding second opening 27 extends upwardly. The corresponding second opening 27 is recessed in and along both opposite sides of the cavity 21. A bottom of the opening 27 is formed by the bottom 22 of the corresponding cavity 21, FIG. 7. The second opening 27 providing a widened portion extending along the corresponding cavity 21, with the first locking lance 25 being received along said widened portion without locking engagement with said housing 2, when the boardlock 4 faces said second of said two directions. Alternatively, the second locking lance 26 is received along said widened portion without locking engagement with said housing 2 when the boardlock 4 faces said first of said two directions. Accordingly, only one locking lance, either 15 or 16 needs to be deflected to enable removal of a corresponding boardlock 4 from the housing 2.

An advantage of the invention resides in an electrical connector having a boardlock that can be unlocked from locked engagement with an insulating housing by deflecting a single locking lance on the boardlock, thereby enabling removal of the boardlock for repair and reconstruction purposes.

Another advantage of the invention resides in an electrical connector having a boardlock constructed with symmetry about a central axis, whereby the boardlock is capable of facing in either one of two directions during insertion within a housing of the connector to avoid incorrect assembly of the boardlock in the housing.

What is claimed is:

1. An electrical connector comprising: an insulating housing; conductive electrical contacts in the housing extending toward a mating face on the housing; at least one conducting boardlock projecting from a mounting surface on the housing for insertion into respective apertures in a circuit board; and each boardlock being received in a corresponding cavity in the housing from an insertion face thereof;

each of the boardlocks comprises: a unitary substantially planer metal plate, a first post portion projecting from a top of the plate, a second post portion projecting from a bottom of the plate, the first and second post portions extending along an axis of rotation, and first and second locking lances in the plate symmetrically spaced radially from the axis of rotation, both locking lances projecting out of the plane of the boardlock and being resiliently bendable toward and away from the plane; and wherein:

each corresponding cavity is intersected by a corresponding opening in the housing, internal walls on each opening provide first and second locking shoulders adjacent to opposite sides of the corresponding cavity facing away from said insertion face, and each boardlock is capable of facing in either of two directions within the corresponding cavity to avoid incorrect assembly of the boardlock, with the first locking lance being lockingly engaged on the first shoulder when the boardlock faces a first of said two directions, and with the second locking lance being lockingly engaged on the second shoulder when the boardlock faces a second of said two directions, whereby successful assembly of the boardlock is achieved with the boardlock facing in either of said two directions, and further wherein each corresponding cavity extends along a second opening into the insertion face, the second opening providing a widened portion extending along each corresponding cavity, the first locking lance being received along said second widened portion without locking engagement with said bousing when the boardlock faces said second of said two directions, the second locking lance being received along said second widened portion without locking engagement with said housing when the boardlock faces and first of said two directions, whereby only one of the locking laces lockingly engages the housing, thus facilitating tool-assisted lance disengagement for boardlock removal.

2. An electrical connector as recited in claim 1 wherein, both said lances project out of the plane of thickness in the same direction.

3. An electrical connector as recited in claim 1 wherein, the second widened portion provides clearances extending along respective opposite sides of each said corresponding cavity to prevent locking engagement of the housing with the first and second locking lances received along respective clearances.

4. An electrical connector as recited in claim 1 wherein, the second opening extends from a top of the housing to enable insertion of a tool along the second opening to deflect said one of the locking lances and to unlock said one of the locking lances from the housing.

* * * * *